US009649649B2

(12) United States Patent
Chang

(10) Patent No.: US 9,649,649 B2
(45) Date of Patent: May 16, 2017

(54) SPORT-TYPE MULTIFUNCTIONAL SPRAY MINERAL WATER BOTTLE

(71) Applicant: Sun Solutions LTD., Guangdong (CN)

(72) Inventor: Chang Ho Chang, Taoyuan (TW)

(73) Assignee: Sun Solutions LTD., Dongguan (CN)

( * ) Notice: Subject to any disclaimer, the term of this patent is extended or adjusted under 35 U.S.C. 154(b) by 0 days.

(21) Appl. No.: 14/518,027

(22) Filed: Oct. 20, 2014

(65) Prior Publication Data

US 2015/0034739 A1 Feb. 5, 2015

Related U.S. Application Data

(60) Division of application No. 12/912,426, filed on Oct. 26, 2010, now Pat. No. 9,227,210, which is a continuation-in-part of application No. 12/696,047, filed on Jan. 28, 2010, now abandoned, and a continuation-in-part of application No. 12/757,202, filed on Apr. 9, 2010, now Pat. No. 8,662,419.

(30) Foreign Application Priority Data

Oct. 19, 2010 (CN) ..... 2010 1 0510654

(51) Int. Cl.

| | |
|---|---|
| ***B65D 1/32*** | (2006.01) |
| ***B05B 11/00*** | (2006.01) |
| ***B65D 47/26*** | (2006.01) |
| ***B65D 47/30*** | (2006.01) |
| ***B05B 1/02*** | (2006.01) |

(52) U.S. Cl.

CPC ..... *B05B 11/0032* (2013.01); *B05B 1/02* (2013.01); *B05B 11/0089* (2013.01); *B65D 47/263* (2013.01); *B65D 47/305* (2013.01)

(58) Field of Classification Search

CPC ..... B05B 11/0032; B05B 11/0089; B65D 47/305; B65D 47/263

USPC ..... 222/206, 209, 211, 215; 239/463, 469, 239/470, 487, 488, 327; 215/235, 236, 215/244

See application file for complete search history.

(56) References Cited

U.S. PATENT DOCUMENTS 2,321,428 A * 6/1943 Schloz ..... F23D 11/383 239/466

5,769,325 A * 6/1998 Jouillat ..... B05B 1/3436 222/333

(Continued)

*Primary Examiner* — Jason Boeckmann

(57) ABSTRACT

The invention discloses a cap of spray mineral water bottle, including cap body, spray means and water locking means. This cap of spray mineral water is used with resilient mineral water bottle body to form a multifunctional spray mineral water bottle, which can ensure normal drinking of mineral water as well as carry out spray drinking of water by means of squeezing the bottle body to transform bottle body and increase the pressure inside the bottle, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable.

10 Claims, 15 Drawing Sheets

(56) References Cited

U.S. PATENT DOCUMENTS

| | | | | |
|---|---|---|---|---|
| 5,908,126 | A * | 6/1999 | Wang | B65D 47/305<br>215/229 |
| 6,722,585 | B1 * | 4/2004 | Stradella | B05B 1/3436<br>222/491 |
| 7,938,342 | B2 * | 5/2011 | Octeau | B05B 1/3436<br>239/333 |

* cited by examiner

SPORT-TYPE MULTIFUNCTIONAL SPRAY MINERAL WATER BOTTLE

CROSS REFERENCE TO RELATED APPLICATIONS

This application claims priority to the following patent applications: (1) U.S. patent application Ser. No. 12/912,426, entitled "CAP OF SPRAY MINERAL WATER BOTTLE AND MULTIFUNCTIONAL SPRAY MINERAL WATER BOTTLE" filed on Oct. 26, 2010; U.S. patent application Ser. No. 12/696,047, filed Jan. 28, 2010, (3) U.S. patent application Ser. No. 12/757,202, filed Apr. 9, 2010, (4) Chinese Patent Application CN 201010510654.0, filed Oct. 19, 2010; each of the above-identified applications is hereby incorporated by reference in its entirety as if fully set forth herein.

BACKGROUND

1. Technical Field

The invention relates to a cap of a mineral water bottle, especially refers to a cap of spray mineral water bottle, and multifunctional spray mineral water bottle comprised by the cap.

2. Description of Related Art

The common mineral water bottle includes the cap body which is screwed with the mineral water bottleneck, and the cap body is matched with mineral water bottleneck by means of liquid-tight fit. When you want to drink the mineral water in the bottle, you remove the cap and directly drink the water. This type of cap is used for sealing the mineral water inside the bottle body, and anti-fake function as well. This type of cap has simple functions so that the mineral water bottle matched with the cap has simple functions as well, which cannot satisfy the demands of daily life of people.

Presently the mineral water, which is taken outside the home, is mainly used for drinking. When it is extremely hot or when you watch football in a stadium in the summer heat, you may want to spray the mineral water directly to your face or head to reduce temperature. However, if pouring mineral water, you may waste too much water and it cannot satisfy your demands due to insufficient water. In addition, temperature reduction effect is limited by this type of method and surrounding air cannot be improved if it is dusty. Therefore the conventional cap needs to be modified and perfected.

SUMMARY

A main object of the present invention is to improve the existing cap, to provide a cap of spray mineral water bottle with simple structure and spray function. This cap of spray mineral water is used with resilient bottle body, so that you can drink water directly or use the water to adjust the surrounding air.

Another object of the present invention is to provide a multifunctional spray mineral water bottle comprising this cap.

To achieving the objective above, this invention adopts the following technical solution:

A cap of a spray mineral water bottle, comprising:

A cap body connected with a bottleneck of the spray mineral water bottle by means of liquid-tight fit, and the cap body defining an outlet aperture on an end face of the cap body;

A spray means comprising an atomizing spool and a nozzle, wherein two water channels are defined on an outer wall of the atomizing spool, and atomizing channels are defined on an end face of the atomizing spool and corresponds to the water channels; and wherein a cavity is defined in the nozzle to hold the atomizing spool, and a spray aperture is defined on an end face of the nozzle; and wherein the atomizing spool is secured in the cavity of the nozzle by assembly stress, and the atomizing channels communicate with the spray aperture of the nozzle; and A water locking means comprising a fixing part and a movable part capable of rotating relative to the fixing part, and wherein the fixing part of the water locking means is fixed on an end face of the cap body, and comprises a spherical working face, wherein an outlet is defined in the spherical working face; and wherein the movable part of the water locking means includes a sphere which is matched with the spherical working face of the fixing part by means of liquid-tight fit, and rotates relative to the fixing part; and wherein an inlet is defined in the sphere and corresponds to a rotating track of the outlet of the spherical working face, and wherein the sphere rotates relative to the fixing part, when the inlet of the sphere communicates with the outlet of the spherical working face, the spray means opens to spray water, and when the inlet of the sphere is staggered with the outlet of the spherical working face, the spray means closes, and wherein the movable part defines a receiving space, and the spray means are secured in the receiving space by assembly stress.

The movable part further comprises a first tube extending from the sphere, the receiving space is defined in the first tube and communicates with the inlet.

The cap body comprises a second tube projecting from an interior surface of the end face of the cap body, and the fixing part comprises a third tube projecting from the spherical working face and sleeved in the second tube, and the third tube communicates with the outlet aperture of the cap body and the outlet of the fixing part.

The second tube defines an annular groove on an inner wall of the second tube, and the third tube comprises an annular protuberance projecting from an exterior surface of the third tube and engaging with the annular groove on the inner wall of the second tube of the cap body.

A supporting bracket projects from an interior surface of the receiving space of the first tube, and extends into the cavity of the nozzle to support the atomizing spool.

The fixing part of the water locking means comprises a position means located on the end face of the cap body, the position means is configured for opening and closing the movable part, and allows the movable part to rotate within a specified radian of 90° degrees.

A multifunctional spray mineral water bottle comprising a resilient bottle body and a cap, the cap comprising:

A cap body connected with a bottleneck of the bottle body by means of liquid-tight fit, and the cap body defining an outlet aperture on an end face of the cap body;

A spray means comprising an atomizing spool and a nozzle, wherein two water channels are defined on an outer wall of the atomizing spool, and atomizing channels are defined on an end face of the atomizing spool and corresponds to the water channels; and wherein a cavity is defined in the nozzle to hold the atomizing spool, and a spray aperture is defined on an end face of the nozzle; and wherein the atomizing spool is secured in the cavity of the nozzle by assembly stress, and the atomizing channels communicate with the spray aperture of the nozzle; and A water locking means comprising a fixing part and a movable part capable of rotating relative to the fixing part, and wherein the fixing part of the water locking means is fixed on an end face of the cap body, and comprises a spherical working face, wherein an outlet is defined in the spherical working face; and wherein the movable part of the water locking means includes a sphere which is matched with the spherical working face of the fixing part by means of liquid-tight fit, and rotates relative to the fixing part; and wherein an inlet is defined in the sphere and corresponds to a rotating track of the outlet of the spherical working face, and wherein the sphere rotates relative to the fixing part, when the inlet of the sphere communicates with the outlet of the spherical working face, the spray means opens to spray water, and when the inlet of the sphere is staggered with the outlet of the spherical working face, the spray means closes, and wherein the movable part defines a receiving space, and the spray means are secured on the receiving space by assembly stress.

The movable part further comprises a first tube extending from the sphere, the receiving space is defined in the first tube and communicates with the inlet.

The cap body comprises a second tube projecting from an interior surface of the end face of the cap body, and the fixing part comprises a third tube projecting from the spherical working face and sleeved in the second tube, and the third tube communicates with the outlet aperture of the cap body and the outlet of the fixing part.

The second tube defines an annular groove on an inner wall of the second tube, and the third tube comprises an annular protuberance projecting from an exterior surface of the third tube and engaging with the annular groove on the inner wall of the second tube of the cap body.

A supporting bracket projects from an interior surface of the receiving space of the first tube, and extends into the cavity of the nozzle to support the atomizing spool.

The fixing part of the water locking means comprises a position means located on the end face of the cap body, the position means is configured for opening and closing the movable part, and allows the movable part to rotate within a specified radian of 90° degrees.

This cap of spray mineral water is used with resilient mineral water bottle body to form a multifunctional spray mineral water bottle, which can ensure normal drinking of mineral water as well as carry out spray drinking of water by means of squeezing the bottle body to transform bottle body and increase the pressure inside, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable. This invention features in simple structure and strong practicability, so it has promising market prospect.

DETAILED DESCRIPTION

Figure 1:
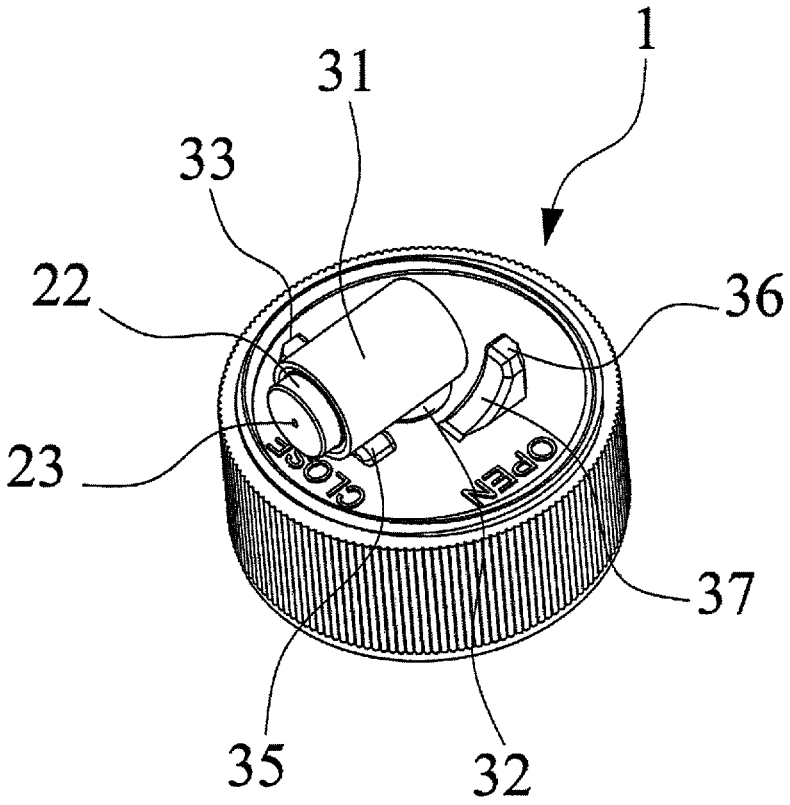
FIG. 1 is the structural schematic view for the cap of spray mineral water bottle of this invention.
Figure 2:
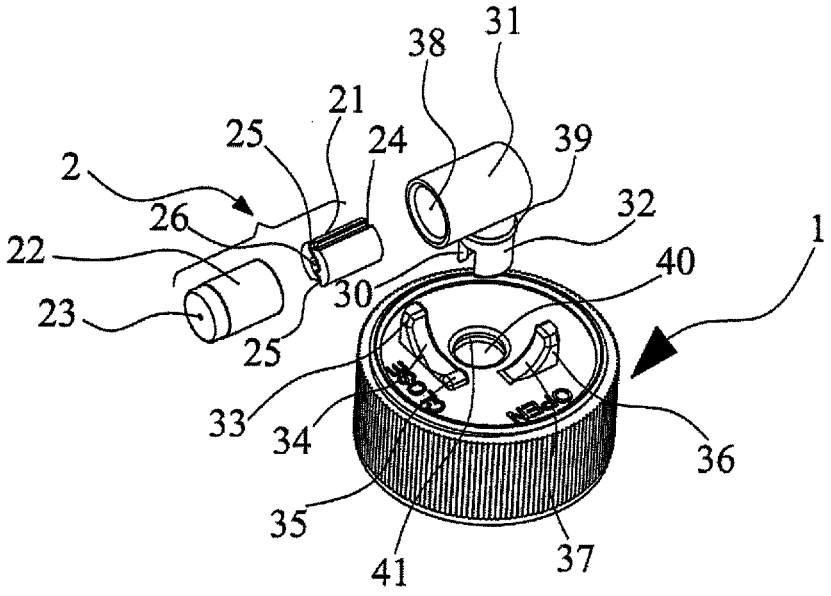
FIG. 2 is the exploded view of FIG. 1.
Figure 3:
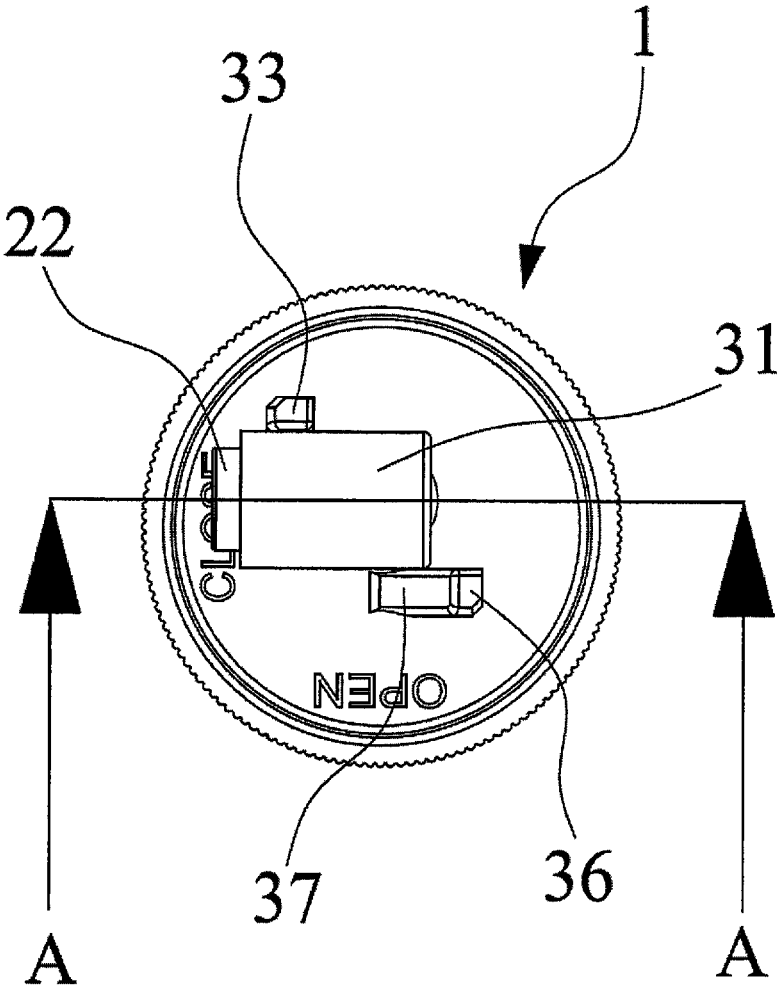
FIG. 3 is the top view of water locking means in opening status in FIG. 1.
Figure 4:
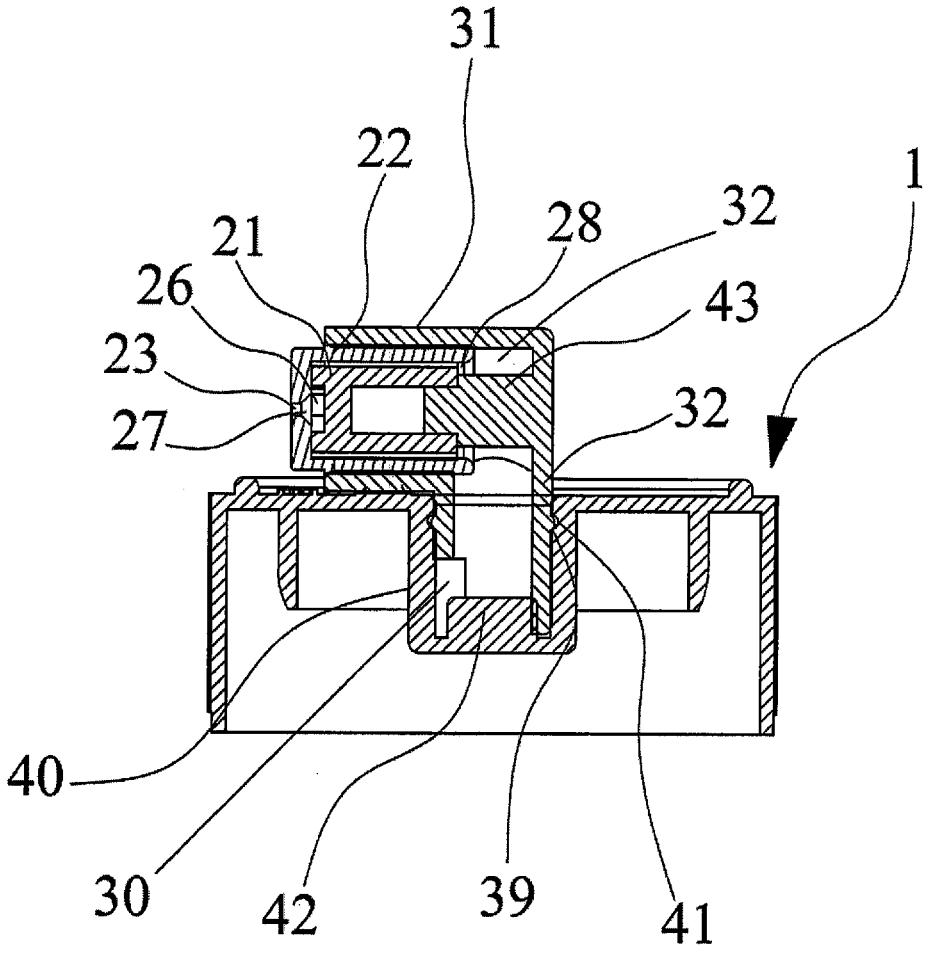
FIG. 4 is the A-A sectional view of FIG. 3.
Figure 5:
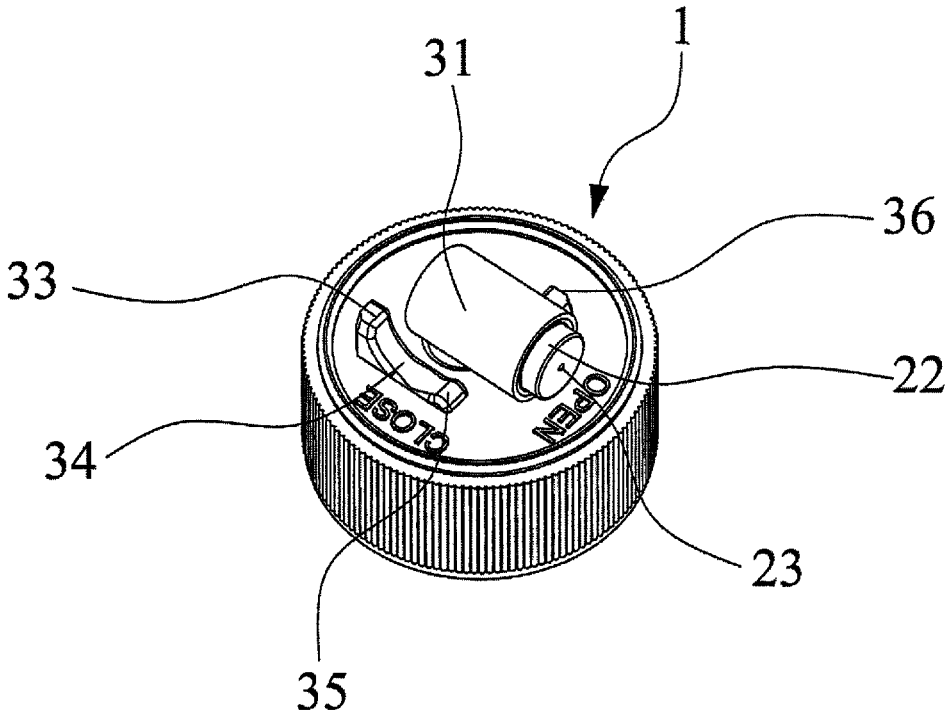
FIG. 5 is the schematic view for water locking means in closing status.
Figure 6:
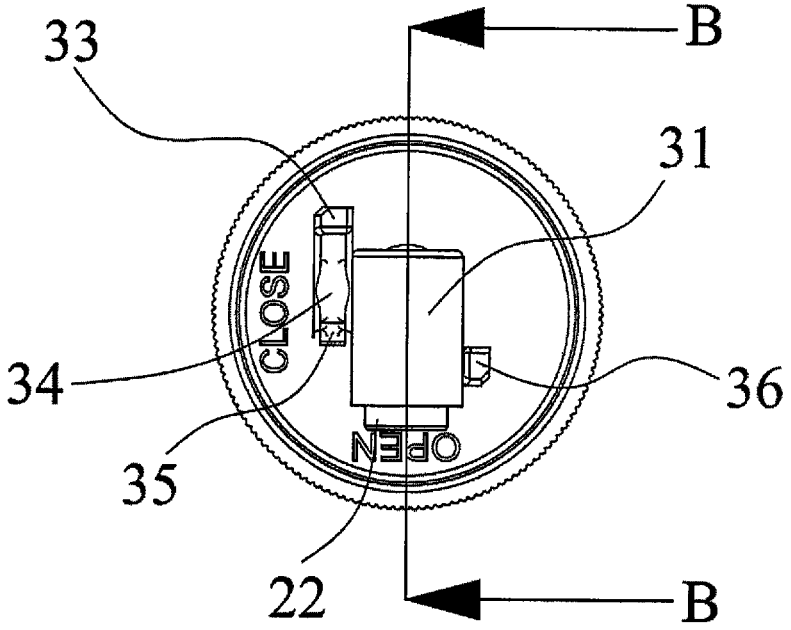
FIG. 6 is the top view of FIG. 5.
Figure 7:
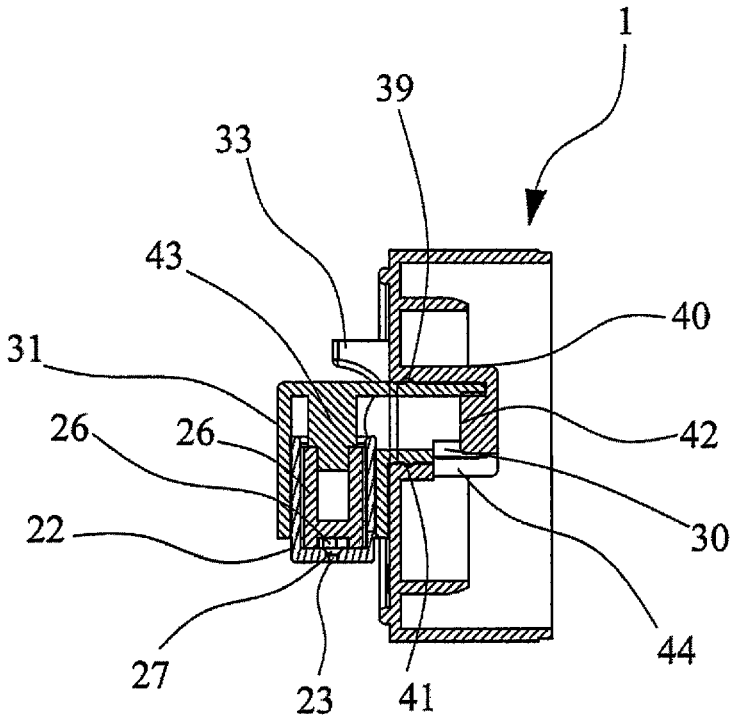
FIG. 7 is the B-B sectional view of FIG. 6.

The present invention will now be described by referring to the accompanying drawings that illustrate the preferred embodiments of the invention, from which its objects and features will be evident.

Embodiment 1

As shown in FIG. 1 to FIG. 7, a cap of spray mineral water bottle, including cap body 1, spray means 2 and water locking means. The cap body 1 and mineral water bottleneck are connected by means of liquid-tight fit, and an outlet is disposed on the end face of cap body 1. A cap body is matched with mineral water bottleneck by means of liquid-tight fit, and an outlet aperture is disposed on the end face of cap body. The spray means 2 includes atomizing spool 21 and nozzle 22, and two water channels 24 are disposed on the outer wall of atomizing spool 21, and the number of water channels can be increased pursuant to the water volume; atomizing channel 26 corresponding to water channel 24 is disposed on the end face of atomizing spool 21 corresponding to the water channel 24, and water channel 24 and atomizing channel 26 are connected by means of two connecting channels 25. Cavity 28 is disposed in nozzle 22 to hold atomizing spool 21, and spray aperture 23 is disposed on the end face of one end of nozzle 21; atomizing spool 21 is matched with the cavity of nozzle 22 by means of interference fit, and atomizing aperture 26 is matched with nozzle 22 by means of coaxial round cavity 27.

The water locking means, including a fixing part 40 and movable part rotating relative to fixing part 40, is a tube located axially in the center of cap body 1, and this tube bottom is closed and a cylindric protuberance 42 is disposed inside the bottom, and outlet 44 is disposed on the sidewall of the tube adjacent to the closing bottom. The movable part of water locking means is right angle shape, including two connected tubes, tube 32 in vertical direction and tube 31 in horizontal direction, and tube 32 and tube 31 are molded into one unit. The outer wall of tube 32 is connected to the tube inner wall of fixing part 40 of water locking means by means of liquid-tight fit, and the port of tube 32 is matched with cylindric protuberance 42. Inlet 30 is disposed at the bottom of tube 32 corresponding to outlet 44, and the movable part rotates relative to fixing part 40 pursuant to tube 32 as axis to fulfill butt joint or interleaving of outlet 44 and inlet 30, and thus to fulfill opening or closing of spray means 2. Cavity 38 is disposed inside tube 31, and support bracket 43 supporting atomizing spool 21 is disposed inside cavity 38, and spray means is disposed inside cavity 38 and connected to cavity 38 by means of interference and liquid-tight fit; support bracket 43 is used to support atomizing spool 21. In order to strengthen the liquid-tight effect between the vertical tube 32 of movable part and tube of fixing part 40, an annular groove 41 is disposed on the inner wall of tube of fixing part 40 of water locking means, and an annular protuberance 39 is disposed on the movable part of the said water locking means, which is matched with groove 41 on the inner wall of tube of fixing part 40. On-off position means of water locking means is disposed on the end face of cap body 1, and the position means includes position blocks 33 and 36 respectively fixed on 0° and 90° positions of end face of cap body 1, respectively positioning opening and closing of water locking means, and cambered surfaces 34 and 37 are disposed on the position blocks in the rotating direction of the tube in the vertical direction to match with the tube. A limiting protuberance 35 is disposed on the cambered surface bottom of the closed position block of the position water locking means corresponding to the other side of the tube in horizontal direction to prevent tube 31 from automatically opening without external force. In addition, due to consideration of hygiene, an auxiliary cap can be added above the cap body, which is flexibly connected with the cap body by means of flexible connecting piece; or a small cap body can be added at one end of spray aperture of the nozzle to strengthen water locking effect and hygiene.

Embodiment 2

Figure 8:
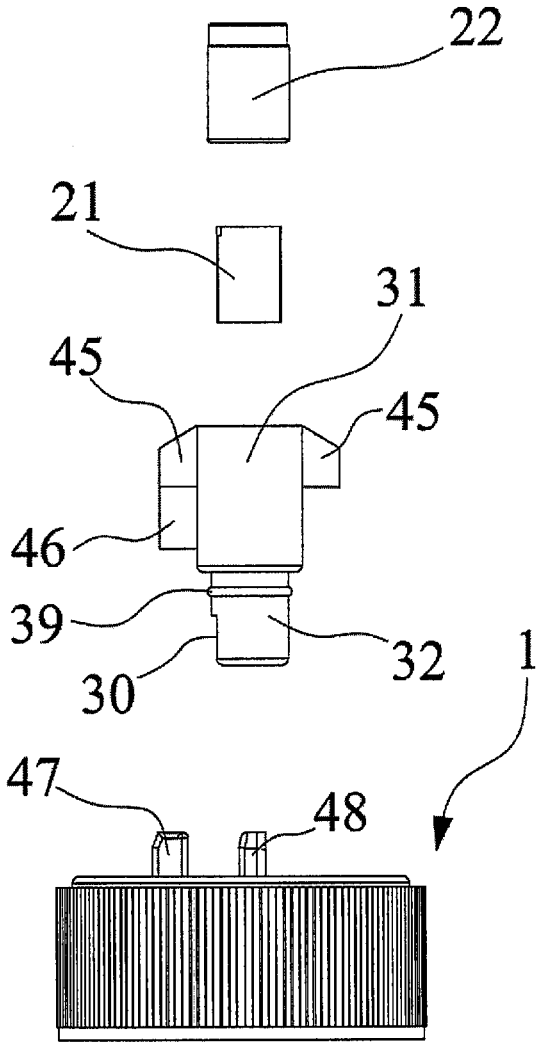
FIG. 8 is the exploded view for the embodiment 2 of the cap of spray mineral water bottle in this invention.
Figure 9:
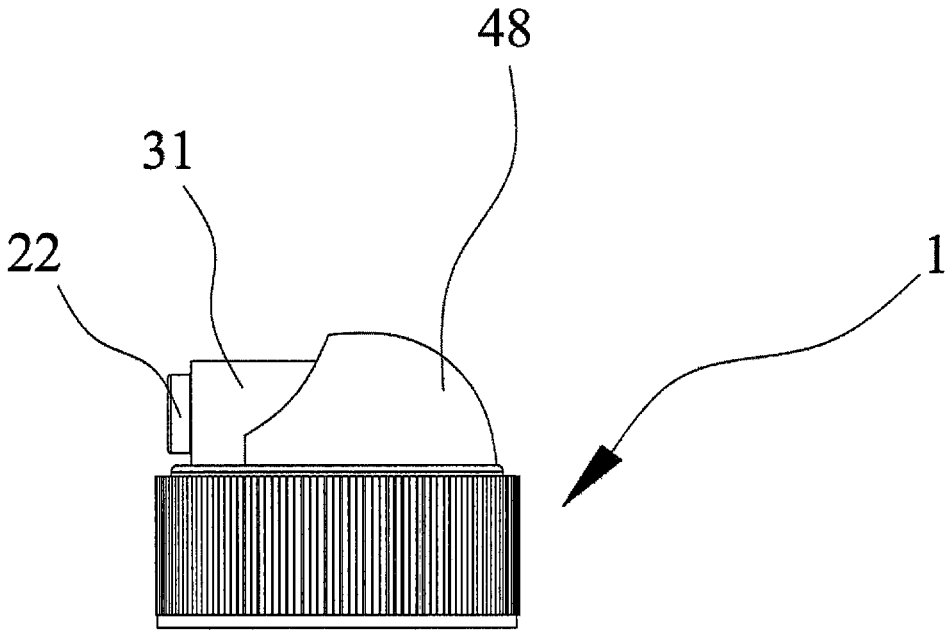
FIG. 9 is the structural schematic view for the embodiment 3 for the cap of spray mineral water bottle in this invention.
Figure 10:
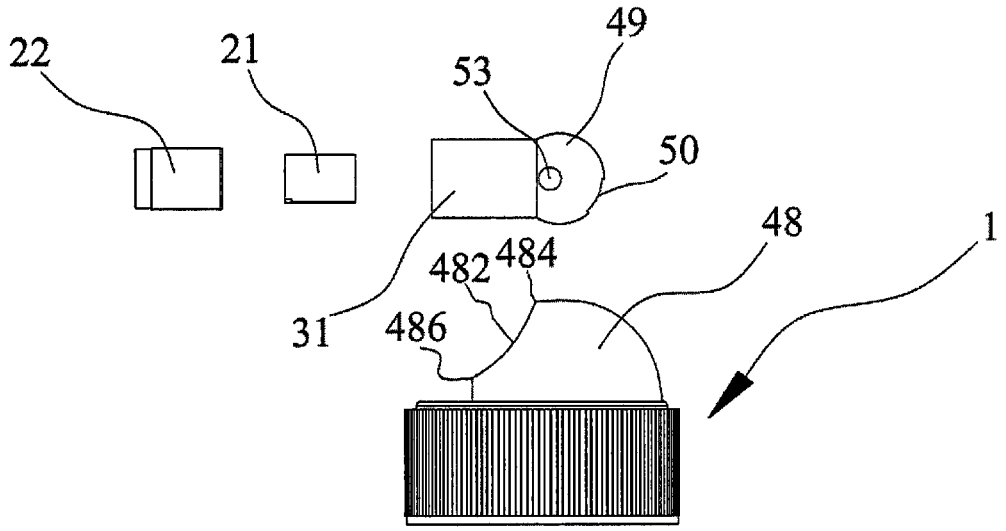
FIG. 10 is the exploded and extended view of FIG. 9.
Figure 11:
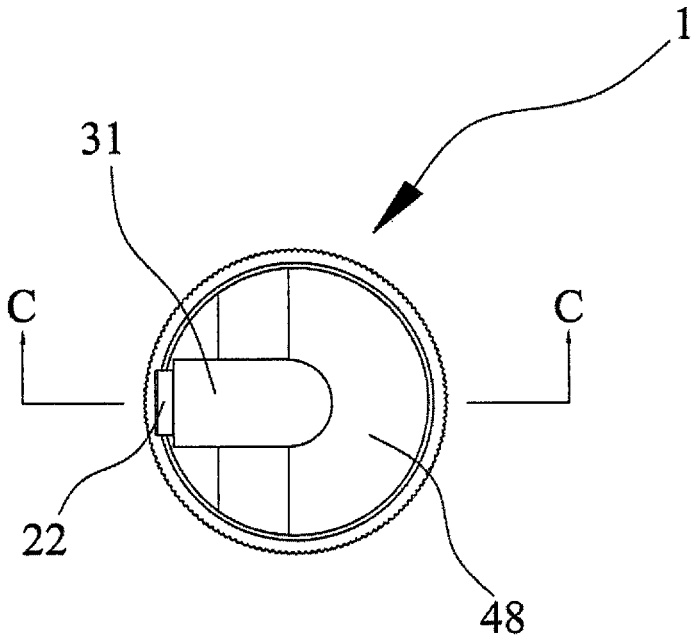
FIG. 11 is the top view of FIG. 9.
Figure 12:
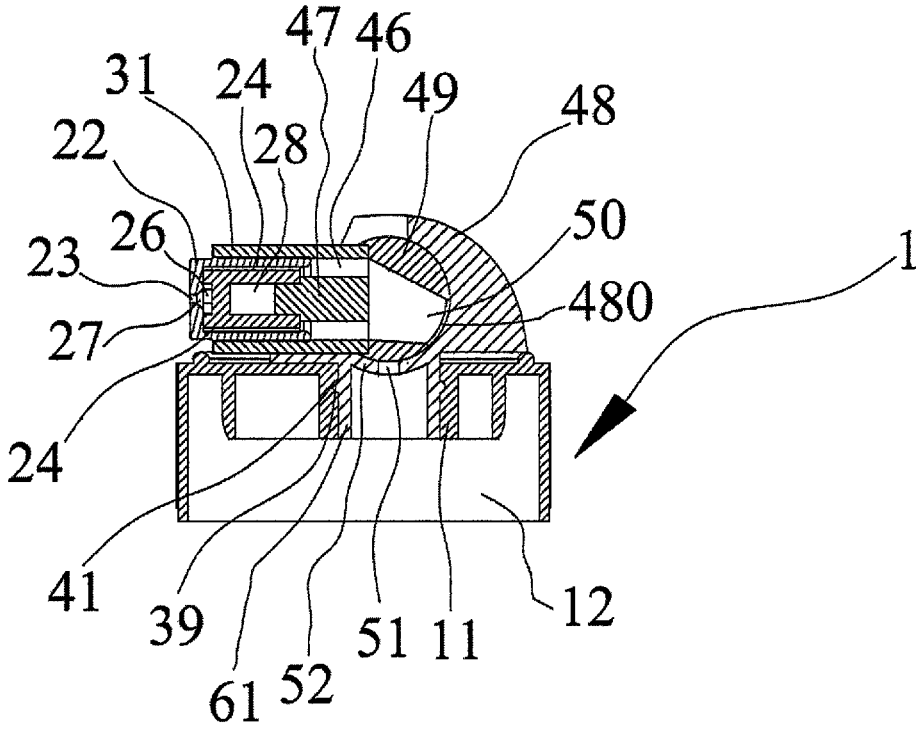
FIG. 12 is the C-C sectional view of FIG. 11.
Figure 13:
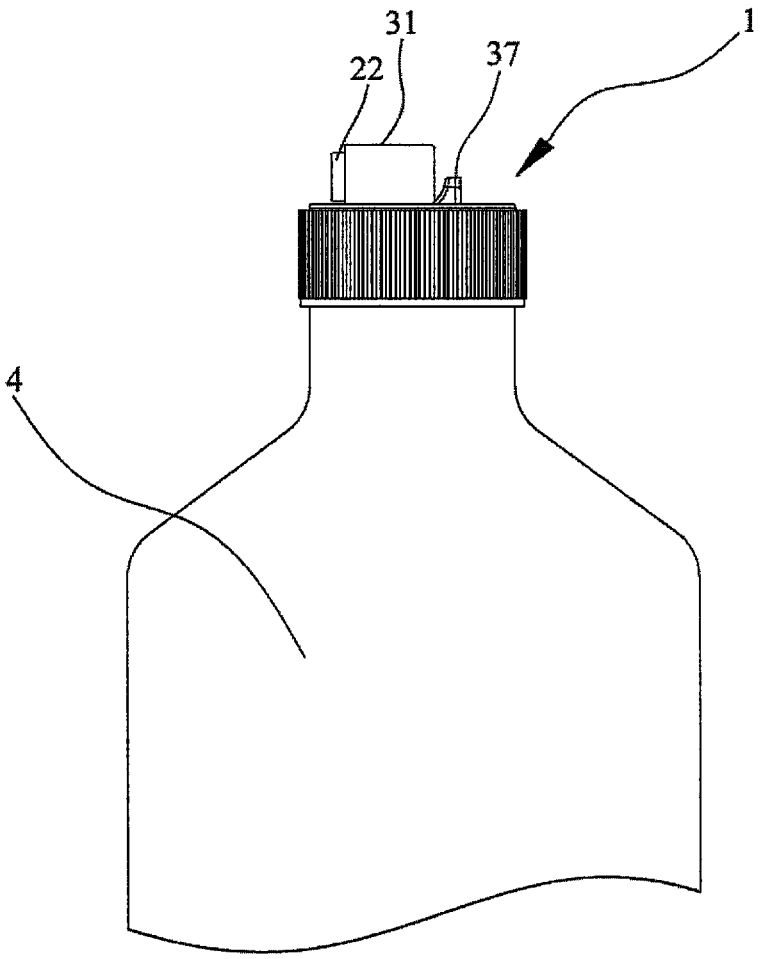
FIG. 13 is the structural schematic view of the multifunctional spray mineral water bottle in this invention.
Figure 14:
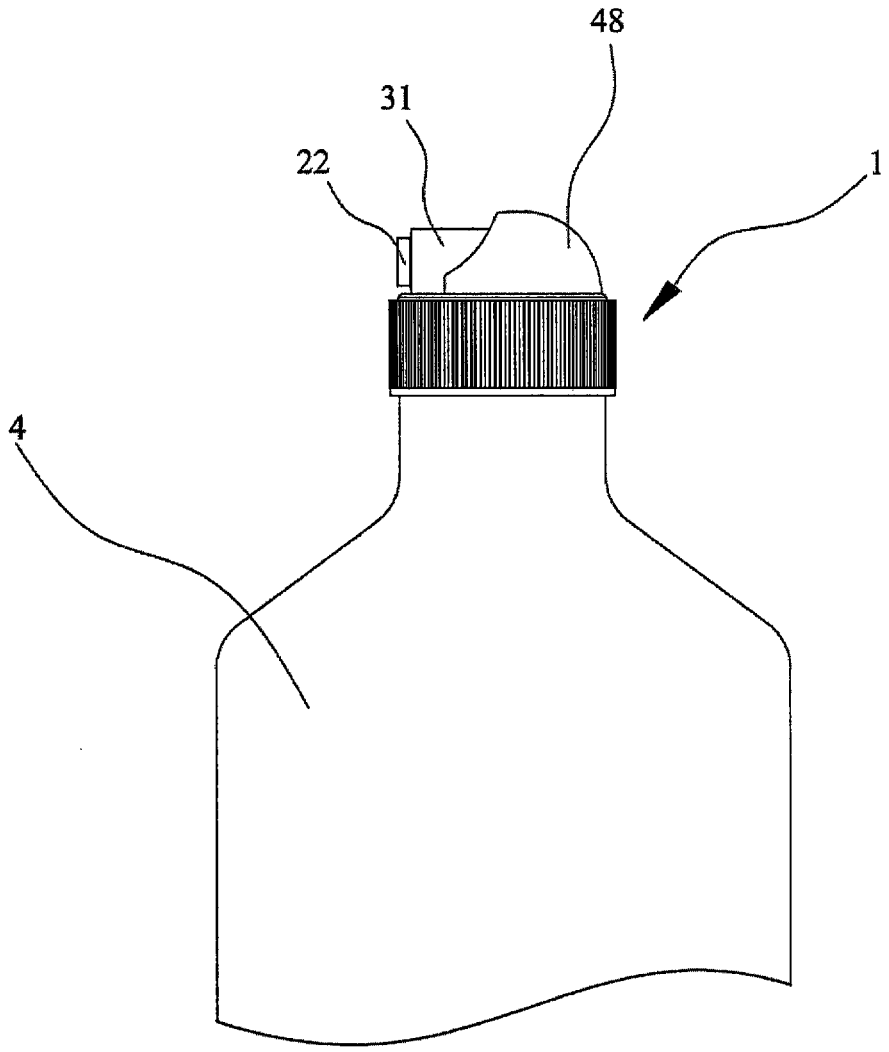
FIG. 14 is the structural schematic view for the embodiment 2 of multifunctional spray mineral water bottle in this invention.

As shown in FIG. 8, in comparison with the right angle shaped movable part of water locking means in the embodiment 1, the movable part of water locking means in embodiment 2 is straight line shape, including movable part tube 31 and tube 32, wherein tube 32 is sleeve jointed inside the fixing part 40 tube in the embodiment 1, annular protuberance 39 is matched with annular groove 41, the bottom port of tube 32 is matched with cylindric protuberance 42 at the bottom of the fixing part tube, the movable part rotates relative to the fixing part back and forth to fulfill the butt joint or interleaving between inlet 30 and outlet 44, thus achieving the opening and closing of the spray means. A cavity is disposed inside tube 31, atomizing spool 21 is sleeve jointed to the cavity of the nozzle to form spray means 2, and the spray means is sleeve jointed to the cavity of tube 31. To facilitate rotation of the movable part of water locking means, rotating handles 45 are disposed at both sides of upper end of tube 31. On-off position means is disposed between the middle of tube 31 and end face of cap body 1, and this position means includes position blocks 47 and 48 respectively fixed on 0° and 90° positions of end face of cap body and limiting stopper 46 fixed on the corresponding position of the movable part.

Embodiment 3

The embodiment 3 is shown in FIG. 9 to FIG. 12, and a cap of spray mineral water bottle includes a cap body 1 connected with a bottleneck of the spray mineral water bottle by means of liquid-tight fit and defining an outlet aperture 12 on an end face of the cap body 1, a spray means, and a water locking means. The spray means includes an atomizing spool 21 and a nozzle 22. Two water channels 24 are defined on an outer wall of the atomizing spool 21, and the number of water channels 24 can be increased pursuant to the water volume. Atomizing channels 26 is defined on an end face of the atomizing spool 21 and corresponds to the water channels 24, and the water channels 24 and the atomizing channels 26 are connected by means of two connecting channels. A cavity 28 is defined in the nozzle 22 to hold the atomizing spool 21, and a spray aperture 23 is defined on an end face of one end of the nozzle 22. The atomizing spool 21 is secured in the cavity 28 of nozzle 22 by assembly stress, and the atomizing aperture 26 is matched with nozzle 22 by means of a coaxial round cavity 27.

The water locking means comprising a fixing part and a movable part capable of rotating relative to the fixing part. The movable part includes a sphere 49 and a first tube 31 extending from the sphere 49. The cap body 1 includes a second tube 11 projecting from an interior surface of the end face of the cap body 1. The fixing part of the water locking means is fixed on the end face of the cap body 1, and includes a position means 48 which defines a receiving room 480 and an opening 482 in communication with the receiving room 48 and has a cambered surface, a spherical working face 52 which is an inner wall of the receiving room 480 and a third tube 61 projecting from the spherical working face 52 and sleeved in the second tube 11, wherein the third tube 61 and the position means 48 are formed integrally. The second tube 11 defines an annular groove 41 on an inner wall of the second tube 11, and the third tube 61 includes an annular protuberance 39 projecting from an exterior surface of the third tube 61 and engaging with the annular groove 41 on the inner wall of the second tube 11 of the cap body 1.

The spherical working face 52 is disposed on an end face of the third tube 61 of the fixing part, and an outlet 51 is defined in the spherical working face 52. The sphere 49 is matched with spherical working face 52 of the fixing part by means of liquid-tight fit and is received in the receiving room 480 through the opening 482, and is rotatably connected with the fixing part by means of a rotating axis 53. An inlet 50 is defined in the sphere 49 and corresponds to a rotating track of the outlet 51 of the spherical working face 52. The third tube 61 communicates with the outlet aperture 12 of the cap body 1 and the outlet 51 of the fixing part. In use, the sphere 49 rotates relative to the fixing part, when the inlet 50 of the sphere 49 communicates with the outlet 51 of the spherical working face 52, the spray means opens to spray water, and when the inlet 50 of the sphere 49 is staggered with the outlet 51 of the spherical working face 52, the spray means closes.

The first tube 31 and the sphere 49 are formed integrally with, and defines a receiving space 46 communicating with the inlet 50 to secure the spray means in the receiving space 46 by assembly stress. A supporting bracket 47 projects from an interior surface of the receiving space 46 of the first tube 31, and extends into the cavity 28 of the nozzle 22 to support the atomizing spool 21. The position means 48 is located on the end face of the cap body 1 and comprises a first locating end 484 and a second locating end 486, and the first tube 31 moves between the first locating end 484 and the second locating end 486 when a user applies a force on the first tube 31. When a first surface of the first tube 31 abuts against the first locating end 484, the movable part is in an opening position, and when a second surface of the first tube 31 abuts against the second locating end 486, the movable part is in a closing position. The position means 48 allows the movable part to rotate within a specified radian of 90° degrees.

Embodiment 4

A multifunctional spray mineral water bottle is shown in FIG. 13 and FIG. 1 to FIG. 7, including resilient bottle body 4 and cap of spray mineral water bottle. The resilient bottle body and cap of spray mineral water bottle contain cap body 1, spray means 2 and water locking means. Cap body 1 is matched with mineral water bottleneck by means of liquid-tight fit, and an outlet is disposed on the end face of cap body 1. A cap body is matched with mineral water bottleneck by means of liquid-tight fit, and an outlet aperture is disposed on the end face of cap body. Spray means 2 includes atomizing spool 21 and nozzle 22, and two water channels 24 are disposed on the outer wall of atomizing spool 21, the number of water channels can be increased pursuant to the water volume; atomizing channel 26 corresponding to water channel 24 is disposed on the end face of atomizing spool 21 corresponding to water channel 24, water channel 24 and atomizing channel 26 are connected by means of two connecting channels 25. Cavity 28 is disposed in nozzle 22 to hold atomizing spool 21, and spray aperture 23 is disposed on the end face of one end of nozzle 21; atomizing spool 21 is matched with nozzle 22 cavity by means of interference fit, and atomizing aperture 26 is matched with nozzle 22 by means of coaxial round cavity 27.

The water locking means includes fixing part 40 and movable part rotating relative to fixing part 40, where fixing part 40 is a tube located axially in the center of cap body 1, and this tube bottom is closed and cylindric protuberance 42 is disposed inside the bottom, and outlet 44 is disposed on the sidewall adjacent to the closing end of the tube. The movable part of water locking means is right angle shape, including the connected tubes, tube 32 in vertical direction and tube 31 in horizontal direction, and tube 32 and tube 31 are molded into one unit. The outer wall of tube 32 is matched with the inner wall of the tube of fixing part 40 of water locking means by means of liquid-tight fit, and the port of tube 32 is matched with cylindric protuberance 42. Inlet 30 is disposed at the bottom of tube 32 corresponding to outlet 44, the movable part rotates relative to fixing part 40 pursuant to tube 32 as axis, to fulfill butt joint or interleaving between outlet 44 and inlet 30, thus achieving opening or closing of spray means 2. Cavity 38 is disposed inside tube 31, support bracket 43 supporting atomizing spool 21 is disposed inside cavity 38, spray means is disposed in cavity 38 and is matched with cavity 38 by means of interference and liquid-tight fit, and support bracket 43 is used to support atomizing spool 21. To strengthen liquid-tight effect between tube 32 of movable part and fixing part 40 tube, annular groove 41 is disposed on the inner wall of fixing part 40 tube of water locking means, annular protuberance 39 is disposed on the said movable part of water locking means, which is matched with groove 41 on the inner wall of fixing part 40 tube.

On-off position means of water locking means is disposed on the end face of cap body 1, this position means includes position blocks 33 and 36 respectively fixed on the position of 00 and 900 on the end face of cap body 1, respectively positioning opening and closing of water locking means, and cambered surfaces 34 and 37 are disposed in the rotating direction of the tube in vertical direction on the position blocks to match with the tube. Limiting protuberance 35 is disposed on the cambered surface bottom of the closed position block of the position water locking means, to prevent tube 31 from automatically opening without external force.

Embodiment 5

A multifunctional spray mineral water bottle is shown in FIG. 14 and FIG. 9 to FIG. 12, including resilient bottle body 4 and cap of spray mineral water bottle. The structure of the cap of spray mineral water bottle is described in Embodiment 3, so it will not be repeated here.

Embodiment 6

Figure 15:
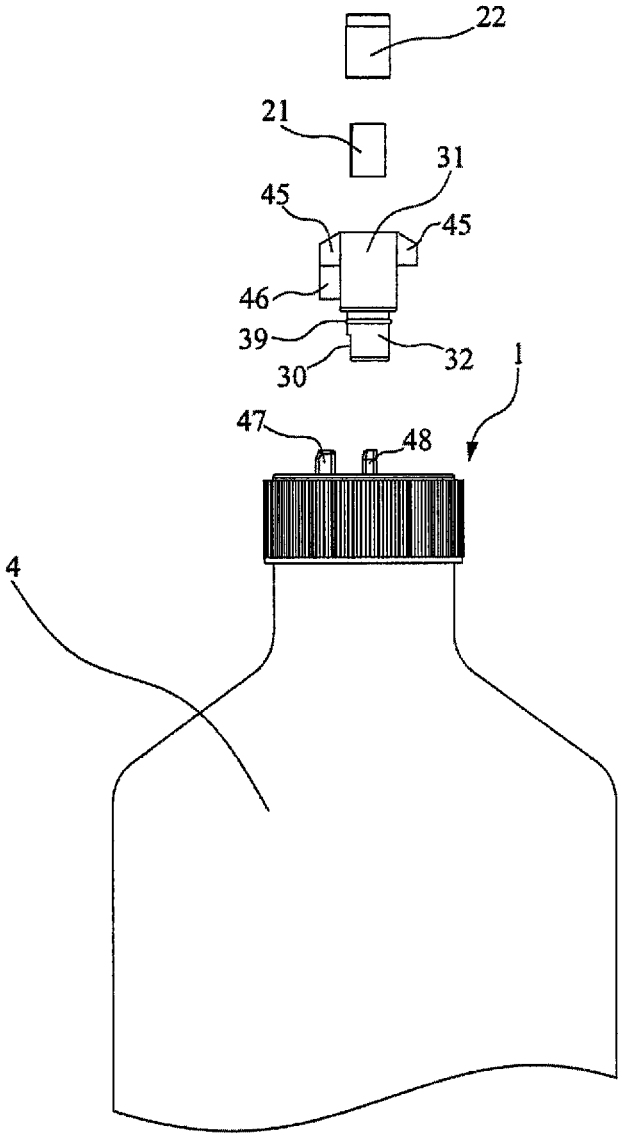
FIG. 15 is the structural schematic view for the embodiment 3 of multifunctional spray mineral water bottle in this invention.

A multifunctional spray mineral water bottle is shown in FIG. 15 and FIG. 8, including resilient bottle body 4 and cap of spray mineral water bottle. The structure of the cap of spray mineral water bottle is described in Embodiment 2, so it will not be repeated here.

This cap of spray mineral water is used with resilient mineral water bottle body to form a multifunctional spray mineral water bottle, which can ensure normal drinking of mineral water as well as carry out spray drinking of water by means of squeezing the bottle body to transform bottle body and increase the pressure inside, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable. This invention features in simple structure and strong practicability, so it has promising market prospect.

The foregoing descriptions of the embodiments and their accompanying drawings of the invention are intended to illustrate and not to limit this invention. Various changes and modifications may be made to the embodiments without departing from the spirit of the invention. Therefore, the scope of the invention is to be limited only by the appended claims.

What is claimed is:

1. A cap of a spray mineral water bottle, comprising:

a cap body connected with a bottleneck of the spray mineral water bottle by liquid-tight fit, and the cap body defining an outlet aperture on an end face of the cap body;

a spray means comprising an atomizing spool and a nozzle, wherein at least two water channels are defined on an outer wall of the atomizing spool, the at least two water channels are configured in accordance with a water volume, and atomizing channels are defined on an end face of the atomizing spool and corresponds to the water channels, and the water channels and the atomizing channels are connected by two connecting channels;

and wherein a cavity is defined in the nozzle to hold the atomizing spool, and a spray aperture is defined on an end face of the nozzle, the spray aperture communicates with the atomizing channels by a coaxial round cavity defined in the nozzle;

and a water locking means comprising a fixing part and a movable part capable of rotating relative to the fixing part, and wherein the fixing part of the water locking means is fixed on an end face of the cap body, and the fixing part comprises a position means defining a receiving room and a spherical working face, wherein an outlet is defined in the spherical working face, and the position means defines an opening in communication with the receiving room;

and wherein the movable part of the water locking means comprises a sphere matching with the spherical working face of the fixing part, and the movable part rotates relative to the fixing part;

and wherein an inlet is defined in the sphere and corresponds to a rotating track of the outlet of the spherical working face, and wherein the sphere rotates relative to the fixing part, when the inlet of the sphere communicates with the outlet of the spherical working face, the spray means opens to spray water, and when the inlet of the sphere is staggered with the outlet of the spherical working face, the spray means closes, and wherein the movable part comprises a first tube extending from the sphere and defines a receiving space, and a bar-shaped supporting bracket extends from an interior surface of the receiving space of the first tube toward the cavity of the nozzle to support the atomizing spool.

2. The cap of the spray mineral water bottle of claim 1, wherein the receiving space is defined in the first tube and communicates with the inlet.

3. The cap of the spray mineral water bottle of claim 2, wherein the cap body comprises a second tube projecting from an interior surface of the end face of the cap body, and the fixing part comprises a third tube projecting from the spherical working face and sleeved in the second tube, and the third tube communicates with the outlet aperture of the cap body and the outlet of the fixing part, where in the third tube and the position means are formed integrally.

4. The cap of the spray mineral water bottle of claim 3, wherein the second tube defines an annular groove on an inner wall of the second tube, and the third tube comprises an annular protuberance projecting from an exterior surface of the third tube and engaging with the annular groove on the inner wall of the second tube of the cap body.

5. The cap of the spray mineral water bottle of claim 1, wherein the position means allows the movable part to rotate within a specified radian of 90 degrees.

6. The multifunctional spray mineral water bottle of claim 1, wherein the position means allows the movable part to rotate within a specified radian of 90 degrees.

7. A multifunctional spray mineral water bottle, comprising:

a resilient bottle body and a cap;

the cap comprising a cap body connected with a bottleneck of the bottle body by liquid-tight fit, and the cap body defining an outlet aperture on an end face of the cap body;

a spray means comprising an atomizing spool and a nozzle, wherein at least two water channels are defined on an outer wall of the atomizing spool, the at least two water channels are configured in accordance with a water volume, and atomizing channels are defined on an end face of the atomizing spool and corresponds to the water channels, the spray aperture communicates with the atomizing channels, and the water channels and the atomizing channels are connected by two connecting channels;

and wherein a cavity is defined in the nozzle to hold the atomizing spool, and a spray aperture is defined on an end face of the nozzle, the spray aperture communicates with the atomizing channels by a coaxial round cavity defined in the nozzle;

and a water locking means comprising a fixing part and a movable part capable of rotating relative to the fixing part, and wherein the fixing part of the water locking means is fixed on an end face of the cap body, and the fixing part comprises a position defining a receiving room and a spherical working face, wherein an outlet is defined in the spherical working face, and the position means defines an opening in communication with the receiving room;

and wherein the movable part of the water locking means includes a sphere matching with the spherical working face of the fixing part, and the movable part rotates relative to the fixing part;

and wherein an inlet is defined in the sphere and corresponds to a rotating track of the outlet of the spherical working face, and wherein the sphere rotates relative to the fixing part, when the inlet of the sphere communicates with the outlet of the spherical working face, the spray means opens to spray water, and when the inlet of the sphere is staggered with the outlet of the spherical working face, the spray means closes, and wherein the movable part comprises a first tube extending from the sphere and defines a receiving space, and a bar-shaped supporting bracket extends from an interior surface of the receiving space of the first tube toward the cavity of the nozzle to support the atomizing spool.

8. The multifunctional spray mineral water bottle of claim 7, wherein the receiving space is defined in the first tube and communicates with the inlet.

9. The multifunctional spray mineral water bottle of claim 8, wherein the cap body comprises a second tube projecting from an interior surface of the end face of the cap body, and the fixing part comprises a third tube projecting from the spherical working face and sleeved in the second tube, and the third tube communicates with the outlet aperture of the cap body and the outlet of the fixing part, where in the third tube and the position means are formed integrally.

10. The multifunctional spray mineral water bottle of claim 9, wherein the second tube defines an annular groove on an inner wall of the second tube, and the third tube comprises an annular protuberance projecting from an exterior surface of the third tube and engaging with the annular groove on the inner wall of the second tube of the cap body.

* * * * *